United States Patent [19]

DeLucia

[11] 3,975,069

[45] Aug. 17, 1976

[54] COLLAPSIBLE ENCLOSURE FOR LAVATORIES OR THE LIKE

[76] Inventor: Philip A. DeLucia, 57 Lincoln Ave., Cliffside Park, N.J. 07010

[22] Filed: Dec. 20, 1974

[21] Appl. No.: 534,770

[52] U.S. Cl. ..... 312/262; 312/258; 312/140.1

[51] Int. Cl.[2] ..... A47B 43/00

[58] Field of Search ..... 312/262, 258, 140.1, 312/140.2; 297/417

[56] References Cited

UNITED STATES PATENTS

| | | | |
|---|---|---|---|
| 578,445 | 3/1897 | Cobleigh | 312/262 |
| 963,853 | 7/1910 | Benson | 312/258 |
| 1,008,574 | 11/1911 | Weinstock | 312/258 |
| 1,399,744 | 12/1921 | Brophy | 297/417 |
| 3,347,591 | 10/1967 | Soroos et al. | 312/140.1 |
| 3,458,242 | 7/1969 | Williams | 312/258 |
| 3,644,011 | 2/1972 | MacDonald | 312/258 |
| 3,752,552 | 8/1973 | MacDonald | 312/258 |
| 3,865,051 | 2/1975 | Johl et al. | 312/258 |

FOREIGN PATENTS OR APPLICATIONS

| | | | |
|---|---|---|---|
| 1,257,501 | 12/1961 | France | 312/258 |
| 1,371,349 | 12/1964 | France | 312/258 |
| 14,956 | 12/1913 | United Kingdom | 312/262 |

*Primary Examiner*—Paul R. Gilliam
*Assistant Examiner*—Victor N. Sakran
*Attorney, Agent, or Firm*—Martha G. Pugh

[57] ABSTRACT

A collapsible enclosure for lavatories or the like having a front panel frame, a pair of substatially identical side panels and a bottom panel, which in assembled position form a partially enclosed rectangular housing. A stiffening brace disposed normally between the side panels at their rear top edges forms the fourth edge of a rectangular support for a removable flat top panel having a vertically disposed flange across the back edge and a round opening to accommodate the lavatory. The bottom panel folds up against the front frame. The two side panels rotate horizontally on composite hinges, one side of a clockwise direction and the other side in a counterclockwise direction, to assume adjacent positions parallel to the folded bottom panel. The two front corner hinge composites are designed so that one includes a substantially wider center leaf than the other. The rear stiffening brace, which is supported on a pivot on a third hinge composite, rotates in both a vertical and horizontal plane, to assume a position coplanar with one of the sides when the latter is folded into place. The removed top panel is disposed with its flange adjacent one edge of the folded assemblage, the flat horizontal section and circular opening being positioned adjacent the door panels for protecting the front surface and decorative hardware during storage and/or shipment.

2 Claims, 11 Drawing Figures

COLLAPSIBLE ENCLOSURE FOR LAVATORIES OR THE LIKE

BACKGROUND OF THE INVENTION

This relates in general to foldable and collapsible furniture and, more particularly, to collapsible devices for enclosing and providing storage space beneath lavatory sinks and the like.

Many different styles and designs are available for wall cabinets of the types described, which are sometimes known in the trade as "vanities". The prinicipal economic problem from the standpoint of dealers in this type of furniture is that assembled units are bulky for packing and shipping and take up substantial storage space in a commercial establishment. On the other hand, if the dealer purchases units which are disassembled for storage purposes, valuable time and effort are required to assemble them.

SUMMARY OF THE INVENTION

Accordingly, it is the principal object of this invention to provide a unit for enclosing and providing storage space beneath lavatories, sinks and the like, which is compact in form for packing, shipping and storing and which is quickly and easily assembled in a form for store display and use by the customer.

This and other objects are realized in accordance with the present invention in a collapsible unit of the type known as a "vanity", which is installed to enclose and provide storage space beneath lavatories, sinks and the like. Fully assembled, the unit of the present invention comprises a rectangular cabinet having a bottom panel resting on a supporting base, a front panel frame with a pair of laterally opening doors, two substantially similar rectangular one-piece side panels and an open back, except for a stiffening brace which fits between the rear edges of the side panels, forming a fourth edge across the top. A separate cover fits onto and is supported by the upper edges of the front frame, side panels and stiffening brace. The flat upper cover has a circular opening which is constructed to accommodate a standard lavatory, and has a flange across the rear edge. The floor or bottom panel is hinged along the lower member of the front panel frame so that the floor bottom panel folds up adjacent the inside face of the closed front doors.

A particular feature of the invention comprises the hinge arrangements. Each of the two panels is hinged to an opposite end of the front panel frame by a hinge composite comprising a pair of vertical hinges spaced apart by a connecting leaf, and having two lateral leaves. One of the lateral leaves of each hinge composite is fastened adjacent the respective inner end of the front panel frame, while the other lateral leaf of each composite is fastened to its respective side panel. Each connecting leaf is designed to swing freely, being connected only to the hinges at its two opposite edges. The connecting leaf of the hinge composite on one side is about twice as wide as the connecting leaf of the hinge composite on the other side. Thus, when the floor bottom panel folds up, its thickness is accommodated by the rectangularly disposed hinge composite between the first side panel and the front panel frame, as the first side panel is folded into place against the folded bottom panel. The thickness of the folded bottom panel plus the thickness of the folded first side panel is accommodated by the rectangularly disposed hinge composite between the second side panel and the front panel frame when the second side panel folds into place.

Another feature of the invention is the construction and operation of the stiffening brace. The latter is supported to a first one of the side panels by a third hinge composite comprising three vertical hinges and four lateral leaves. One lateral leaf of the third hinge composite is fastened to the rear upper edge of the first side panel. The remaining three lateral leaves connected between successive pairs of vertical hinges are designed to swing freely. To the leaf on the right-hand end of the hinged, horizontally free swinging leaves is mounted an outwardly protruding pin. The stiffening brace is pivoted about this pin at one end and in assembled position, locks against the second side panel at its other end. In collapsed position, the stiffening brace rotates down to a vertical position. When the first side panel is folded against the folded second side panel, the stiffening brace is moved into coplanar position beside the first side panel by flexing and folding together the composite hinges.

The top member, previously removed, is now disposed with the flanged portion at least partially covering the upper end of the completely folded unit, the circular open portion of the top panel being disposed adjacent the front door panels of the unit. The extra clearance provides a protected position for the ornamental fittings at the front of the unit. The unit is thus in condition for shipping or storage, and is compact enough to be readily portable.

BRIEF DESCRIPTION OF THE DRAWING

Other objects, features and advantages of the invention will be apparent from a study of the detailed description of the invention with reference to the attached drawings, in which.

DETAILED DESCRIPTION

Figure 1:
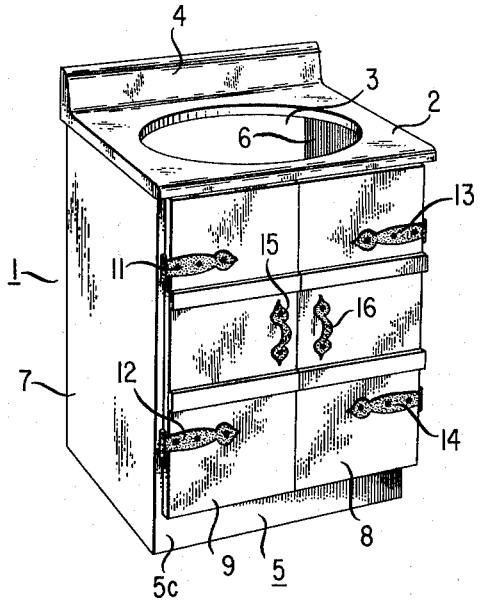
FIG. 1 is a perspective showing of the collapsible enclosure of the present invention, fully assembled, in position to support a lavatory.

Referring to FIG. 1, the fully assembled unit of the present invention is shown in perspective. In preferred form it may be made out of wood, such as pine, of the desired thickness to give the proper strength, such as, for example, ½ inch thick pine board. It will be understood, however, that any of the usual types of wood used for construction of furniture may be substituted, as may other types of materials, such as metal or plastics. In one example, the overall dimension of the unit 1 is 24 inches wide, 22 inches deep and 30 inches high, although here again a wide range of dimensions is applicable in constructing an enclosure in accordance with the teachings of the present invention. A wooden top 2, for example, 24 inches wide, 22 inches deep, comprises a flat wooden piece, ½ inch thick, having a central opening 3, which may be, for example, 15 inches in diameter, or any other diameter suitable for accommodating a lavatory sink. Extending full length across the widest dimension of the top 2 is a vertically extending flange 4, which may be, for example, 6 inches high and ½ inch thick. The top 2 is not fixed to the supporting enclosure and is readily removable.

The present example comprises a pair of rectangular side panels 6 and 7, 22 inches wide, 30 inches high. A pair of doors 8 and 9, which are 21½ inches long by 10 inches wide, are fastened to the rectangular front panel frame 5, along a line about 5½ inches above the floor, by pairs of ornamental hinges 11 and 12 on one side and 13 and 14 on the other side, which permit the doors to be opened out laterally by means of the ornamental handles 15 and 16. It will be understood that the invention is in no way limited to the specific ornamental design disclosed. For example, a single door may be substituted for the double doors shown, and many different types of panels and hardware may be employed.

Figure 2:
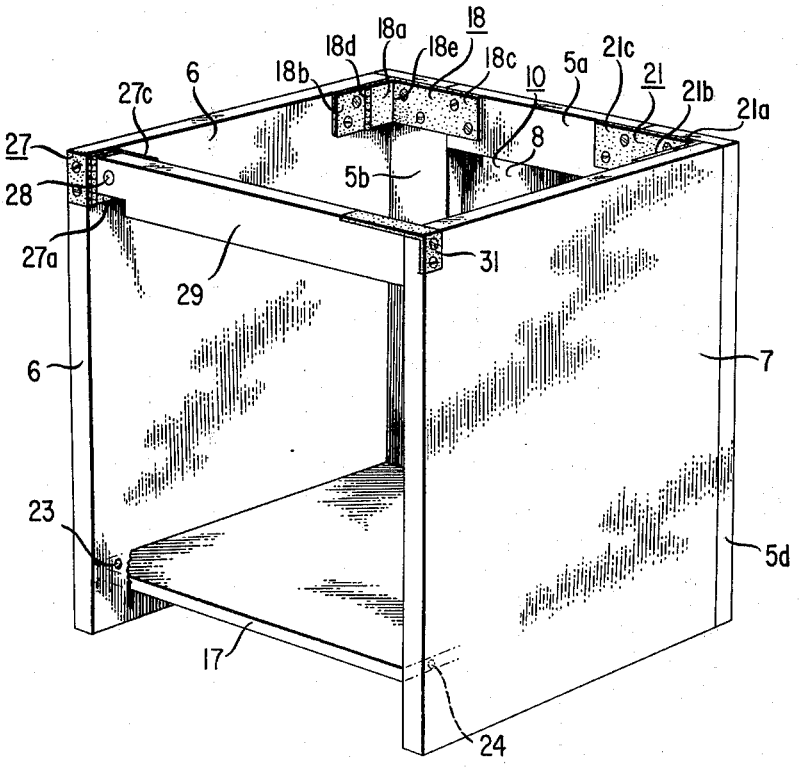
FIG. 2 is a perspective showing of the collapsible enclosure of my invention, as viewed from the rear, fully assembled, except that the top has been removed.

FIG. 2 shows the assembled unit 1 of FIG. 1 with the lid 2 removed, enabling one to view the internal construction of the enclosure, as assembled.

It will be noted from the rear view that the doors 8 and 9 are fastened to a rectangular front panel frame 5 comprising members 5*a*, 5*b*, 5*d* and 5*c*, the latter two not being shown in FIG. 2. The frame members are about 5½ inches wide, providing an inner rectangular opening 10 which is 13 inches wide and 19 inches high.

Figure 9:
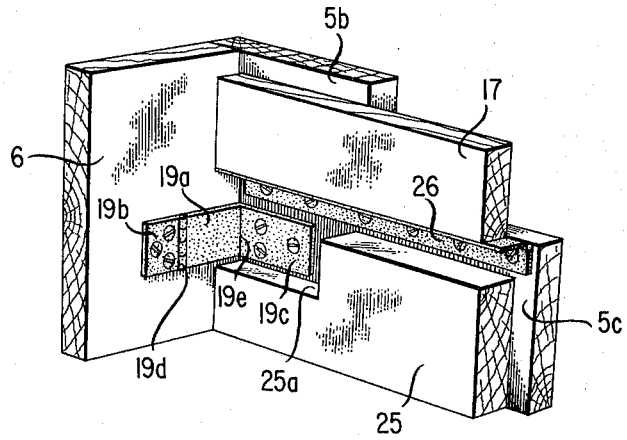
FIG. 9 is a detailed perspective showing of one corner of the enclosure of FIG. 2, showing the detail of one of the hinge composites which is connected between a side panel and the front panel frame, the bottom panel being in raised position.

In the embodiment under description, each of the side panels 6 and 7 is connected to the front panel frame by a pair of hinge composites. The side panel 6 is connected to the left-hand edge 5*b* of the front panel frame 5 by an upper hinge composite 18, and a similar lower hinge composite 19 (not shown in FIG. 2); whereas, the side panel 7 is connected to the right-hand edge 5*d* of the front panel frame 5 by an upper hinge composite 21 and a lower hinge composite 22 (not shown). Reference is made to FIG. 9 which clearly shows the details of the hinge composite 19, which includes a pair of vertically disposed hinges 19*d*, 19*e* spaced apart by a free swinging connecting leaf 19*a*, and having a pair of lateral leaves 19*b* and 19 *c*. Leaf 19*c* is fastened to the inner lower surface of the front frame member 5*b* near its left-hand edge; and, leaf 19*b* is fastened to the inner lower surface of the side panel 6 near its front edge. The other hinge composite 18 at the top of side panel 6, and the hinge composites 21 and 22 (not shown) at the top and bottom of the side panel 7, are of similar construction, with one important difference. The free swinging connecting leaves 18*a* and 19*a* (FIG. 9), which are connected to side panel 6, are approximately twice the width of the corresponding hinge connecting leaves 21*a* and 22*a* (not shown) connected to the side panel 7. This facilitates the accommodation of the folded panels, as will be explained hereinafter.

At the open rear end of the assembled housing, as shown in FIG. 2, a stiffening brace 29, which in the present embodiment comprises a flat board approximately 23 inches long, 5½ inches wide and ½ inch thick, is rotatably mounted near one end on an outwardly protruding pin 28. The pin 28 is fixed to the face of the right-hand lateral leaf 27*c* of the triple hinge complex 27. The latter comprises three vertically disposed hinges 27*d*, 27*e* and 27*f* (see FIGS. 2, 3 and 4) spaced apart by connecting leaves 27*g* and 27*a*, respectively. An additional left-hand lateral leaf 27*b* is fastened to the rear upper edge of the side panel 6. The connecting leaves 27*g* and 27*a* are disposed to swing freely about the vertical hinges 27*d*, 27*e* and 27*f*, moving the panel 27*c* in a horizontal plane, so that when the brace 29 has been rotated downwardly about pin 28 to a depending vertical position, it can then be moved into a coplanar position with side panel 6 as it folds up. The right-hand end of brace 29 has a rectangular hook 31 fastened to it, which hooks over and fastens to the edge of side panel 7 in a rectangular notch 7*a* (see FIG. 4). The stiffening brace 29 has a small rectangular indentation 29*a* which permits it to accommodate the hinge leaf 27*a* when brace 29 is unhooked from the upper edge of side panel 7 and rotated downwardly in a vertical plane. In assembled position, the base member 17 is fully extended in a position parallel to and about 5½ inches above the floor.

Figure 11:
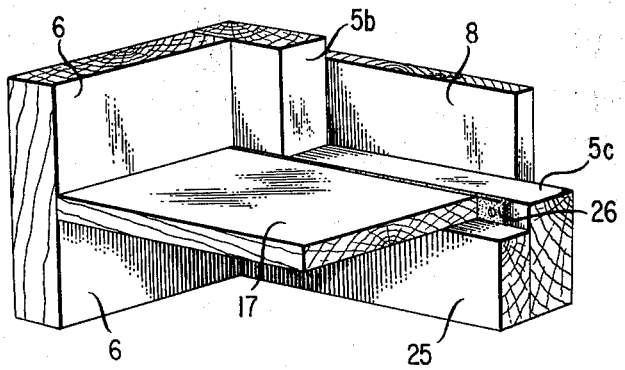
FIG. 11 is a detailed showing of the corner of the enclosure shown in FIG. 9, with the bottom panel in fully extended position.

Referring to FIGS. 9 and 11, it is apparent that the bottom panel 17, which in the present example is a flat wood panel 23 inches wide, about 21 inches long and ½ inch thick, is hinged by means of a simple longitudinal two-leaf hinge 26 to the upper edge of the lower front frame member 5*c*, about 5½ inches above the floor. An auxiliary supporting block 25, about 1 inch thick, 23 inches long and 5½ inches high, is disposed against the inside lateral surface of member 5*c* to provide support for the bottom panel 17 in extended position, as shown in FIG. 11. The block 25 has a small rectangular notch 25*a* to accommodate the leaf 19*c* of the hinge complex 19. When the bottom panel 17 is fully extended, as shown in FIG. 2, it is latched to the respective side panels 6 and 7 by means of conventional latching members 23, 24.

Referring to FIGS. 2–6, the housing 1 is collapsed as follows, after the removal of the top member 2.

The hook 31 of stiffening brace 29 is first unhooked from the upper edge of panel 7, permitting the brace to rotate through an angle of approximately 90°. The hinge leaf 27*c* and the supporting hinge complex 27 are then rotated in a horizontal plane, so that the brace 29 assumes a position next to the edge of side panel 6.

Figure 3:
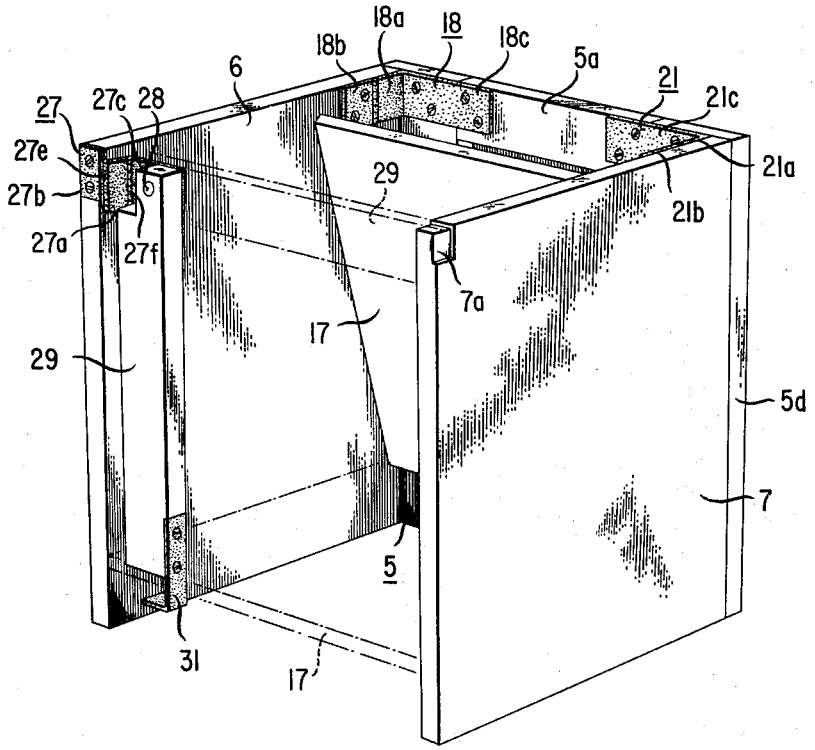
FIGS. 3, 4 and 5 show progressive steps in folding up the unit of FIG. 2.

Latches 23 and 24 are released and the bottom panel 17 is folded up against the front panel frame member 5*a*, as shown in FIG. 3.

Figure 4:
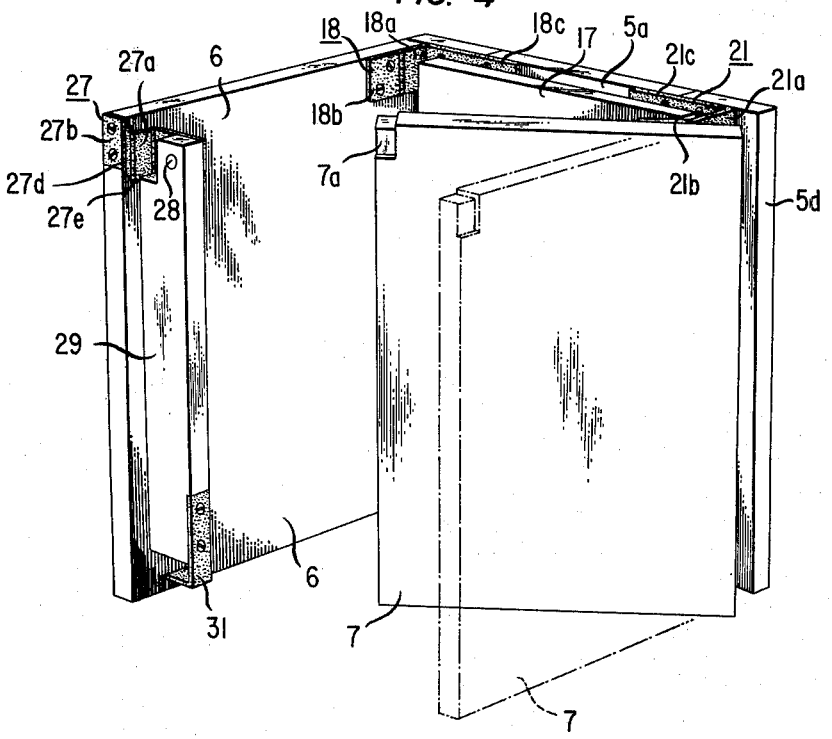

FIG. 4 shows the next step, in which the side panel 7 is rotated horizontally by flexing the hinge 21*d*, folding side panel 7 against the face of the folded bottom panel 17. The hinge leaf 21*a*, in rectangularly folded position of hinge complex 21, is just wide enough to accommodate the bottom panel 17 in folded position.

Figure 5:
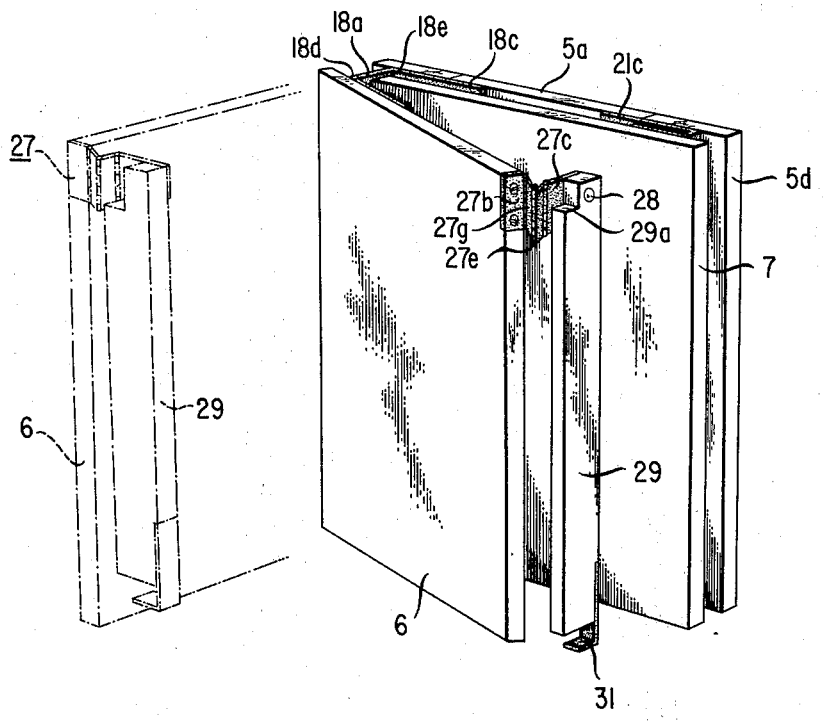
Figure 6:
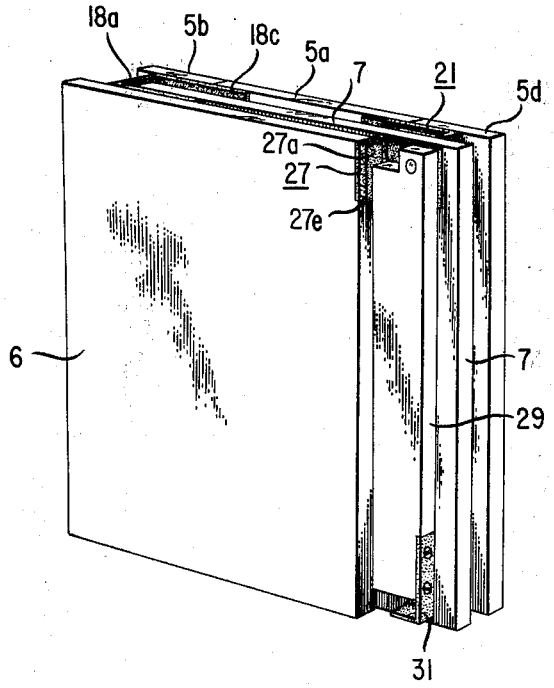
FIG. 6 shows, in perspective, the unit of the present invention fully collapsed.
Figure 10:
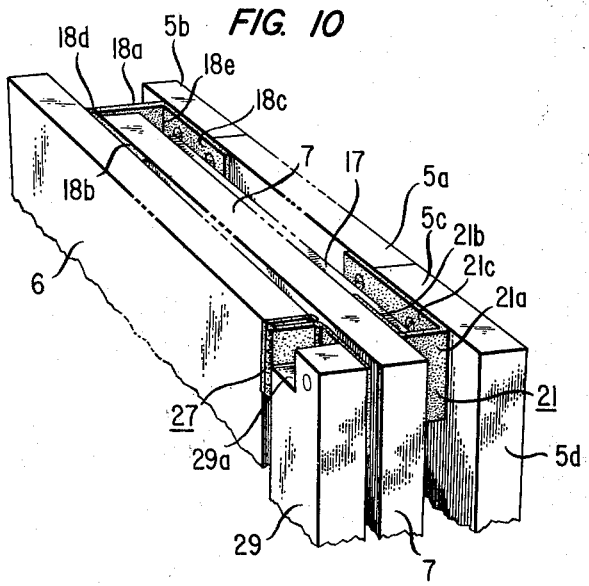
FIG. 10 is a detailed perspective showing looking from above at the completely folded unit, showing the positions of the two upper hinge composites relative to the folded panels.

FIG. 5 shows the final folding step in which the panel 6 is folded into place against the face of folded panel 7 by flexing the hinge 18*d*. The leaf 18*a* between hinges 18*d* and 18*e* is wide enough to accommodate bottom panel 17 and side panel 7 in folded position. As the side panel 6 folds into place, the brace 29 is moved into coplanar position beside it by rotating the lateral leaf 27*c* about the hinge 27*e*, and folding leaf 27*a* against leaf 27*g*. FIG. 6 shows the housing in completely collapsed position. FIG. 10 is a view looking down on the upper edge of the collapsed assemblage, showing the position of each of the folded panels and the hinges.

Figure 7:
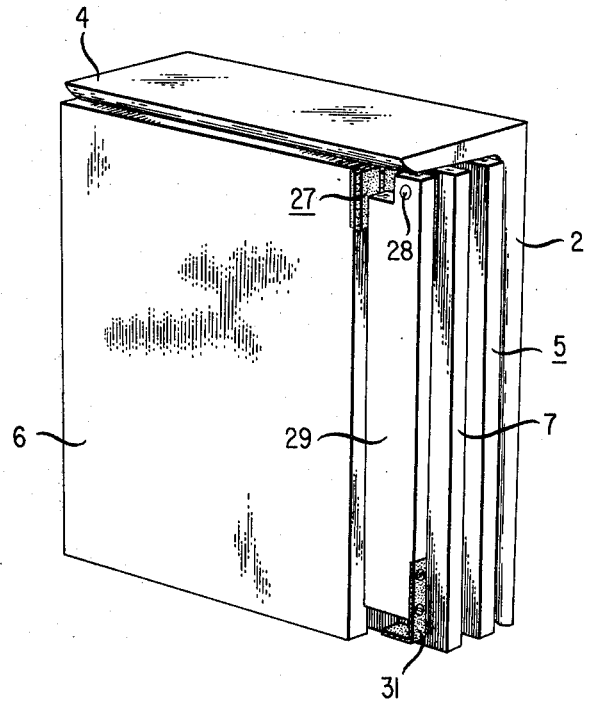
FIG. 7 shows, in perspective, the rear view of the collapsed unit of FIG. 6 assembled for shipping or storage.
Figure 8:
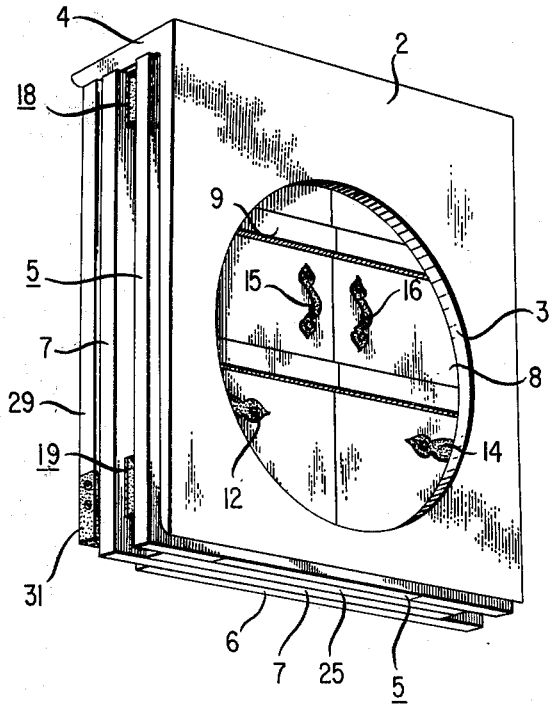
FIG. 8 is a front view of the assemblage of FIG. 7.

As indicated in FIGS. 7 and 8, the top 2 is now placed with the flange 4 across the upper edge of the folded assemblage, with the flat portion and opening 3 adjacent the front doors 8 and 9. It is noted in FIG. 8 that the handles 15 and 16 are accommodated in the opening 3 of the top, so that they need not be removed for shipment.

The dimensions of the folded unit, as shown in FIG. 6, are 24 inches by 30 inches by 8 inches, and the unit is completely portable and readily stored.

It will be apparent that the invention is not restricted to the specific form shown, by way of example, but only by the scope of the appended claims.

What is claimed is:

1. A collapsible housing adapted to house a lavatory basin or the like, comprising in combination:

a. in fully assembled position:

a rectangular front frame constructed to accommodate at least one front panel, first and second rectangular side panels, said side panels connected by hinged composites with said front frame, a bottom panel hinged along the lower horizontal member of said front frame, said front frame, said side panels and said bottom panel forming between them four sides of a partially enclosed rectangular container, an elongated stiffening brace of rectangular cross-section which in the fully assembled position of said housing is disposed with its major face parallel to said front frame and normal to said side panels adjacent their rear upper edges, forming a rigid connection locked into position across the open rear of said enclosure between said first and second side panels, the upper edges of said front frame and said side panels forming with the upper edge of said stiffening brace a rectangular support on the top edge plane of said housing;

b. means for collapsing said housing:

comprising on each of said side panels said hinged composite including at least two vertical hinges laterally spaced apart by a free swinging connecting leaf and having two lateral leaves, one of each of said lateral leaves being fastened to the inside face of said front frame in a position adjacent to a respective side edge of said front frame, the other of each of said lateral leaves being fastened to the inside face of the respective side panel adjacent the nearest end of said front frame, the free swinging connecting leaf of the hinged composite between the front frame and said first side panel being slightly wider than the thickness of said bottom panel in folded position, and the free swinging connecting leaf of the hinged composite between said second side panel and said front panel being slightly wider than the combined thickness of said bottom panel together with the thickness of said first side panel, both in folded position, said bottom panel being constructed and arranged to fold inwardly and upwardly against the inner face of said front frame, said first side panel being constructed and arranged to fold inwardly against the folded under face of said bottom panel, and said second side panel being constructed to fold inwardly against the surface of said first side panel in folded position, a third hinge composite comprising a plurality of vertical hinges spaced apart by connecting leaves, a lateral leaf being connected at each side of said hinge composite, one said lateral leaf fixed to the upper rear edge of said second side panel, and another said lateral leaf disposed to swing freely, a pin fixed to and protruding from the outer surface of said freely swinging lateral leaf, said pin constructed to serve as a pivot for said stiffening brace, said stiffening brace being constructed and arranged to rotate about said pin in a vertical plane, means for locking said stiffening brace in assembled position with the rear top edge of said first side panel, whereby when said stiffening brace is unlocked from the upper position it rotates downwardly through an angle of approximately 90° in a vertical plane, and said free swinging lateral leaf is rotated in a horizontal plane about said hinges to plane the major surface of said stiffening brace in a position coplanar with said second side panel, as said side panel is folded into place against the folded surface of said first side panel, forming a completely folded composite.

2. The combination in accordance with claim 1 including in assembled position a top member comprising a broad flat surface having a length and breadth which approximate the length and breadth of the top of said collapsible housing, and having a flange normally directed in a vertical plane in assembled position of said housing along one of the widest edges of said top member, said flange being constructed with sufficient breadth so that in the collapsed position of said housing said flange at least partially fits over and protects a folded edge portion of said completely folded composite housing, the broad flat surface of said top member having a large circular central opening shaped in assembled position to just accommodate a conventional lavatory sink, in assembled condition of said housing, a pair of doors being laterally hinged to the opposite vertical members of said front frame by vertical hinges respectively placed near the outside edges of said frame so that each of said doors is constructed to open out laterally, said doors including outwardly protruding hardware fittings, wherein in the collapsed condition of said housing to form a completely folded composite, said top member is disposed with its broad flat surface against said front door panels, and said circular opening accommodates and protects said hardware fittings without removal of the same from said doors for storage or shipment.

* * * * *

UNITED STATES PATENT AND TRADEMARK OFFICE

CERTIFICATE OF CORRECTION

PATENT NO. : 3,975,069

DATED : August 17, 1976

INVENTOR(S) : Philip A. DeLucia

It is certified that error appears in the above-identified patent and that said Letters Patent are hereby corrected as shown below:

In the Abstract, line 12, change "of" to --in--. Column 1, line 61, delete "floor". Column 4, line 45, after "of" insert --a pair of--. Column 6, line 28, change "plane" (second occurrence) to --place--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*